United States Patent [19]

Kreitmeier

[11] Patent Number: 4,910,958

[45] Date of Patent: Mar. 27, 1990

[54] AXIAL FLOW GAS TURBINE

[75] Inventor: Franz Kreitmeier, Baden, Switzerland

[73] Assignee: BBC Brown Boveri AG, Baden, Switzerland

[21] Appl. No.: 249,692

[22] Filed: Sep. 27, 1988

[30] Foreign Application Priority Data

Oct. 30, 1987 [DE] Fed. Rep. of Germany ..... 3736836

[51] Int. Cl.[4] ..... F02C 7/18; F01D 5/08

[52] U.S. Cl. ..... 60/39.75; 415/117; 416/95

[58] Field of Search ..... 60/39.75, 39.83; 415/115, 116, 117; 416/95

[56] References Cited

U.S. PATENT DOCUMENTS

| | | | |
|---|---|---|---|
| 4,113,406 | 9/1978 | Lee | 415/115 |
| 4,186,554 | 2/1980 | Possell | 60/39.75 |
| 4,425,079 | 1/1984 | Speak et al. | 415/115 |
| 4,456,427 | 6/1984 | Evans | 60/39.75 |
| 4,469,470 | 9/1984 | Geary | 416/95 |
| 4,551,062 | 11/1985 | Geary | 415/115 |

FOREIGN PATENT DOCUMENTS

| | | |
|---|---|---|
| 2639511 | 3/1977 | Fed. Rep. of Germany . |
| 2549112 | 4/1977 | Fed. Rep. of Germany . |
| 3221323 | 12/1982 | Fed. Rep. of Germany . |
| 3424139 | 1/1986 | Fed. Rep. of Germany . |
| 3712628 | 11/1987 | Fed. Rep. of Germany . |
| 340669 | 10/1959 | Switzerland . |
| 1524956 | 9/1978 | United Kingdom . |

OTHER PUBLICATIONS

Eirmann, Albert; Keppel, Wolfgang, "Die GT13E--Eine Gasturbine Grober Leistung Mit Gutem Wirkungsgrad," *Brown Boveri Technik*, Mar., 1985, pp. 104–110.

*Primary Examiner*—Louis J. Casaregola
*Assistant Examiner*—Timothy S. Thorpe
*Attorney, Agent, or Firm*—Burns, Doane, Swecker & Mathis

[57] ABSTRACT

The cooling-air ducting of the axial flow gas turbine runs in the area of the last blading stage (9+14) radially inwards of the heat-accumulation segments (23, 24) inside the outer boundary of the rotor (4) and through blade root channels (21) in the blade roots of the last moving blade ring (9) and finally through a cooling-air blade ring (28) fixed to the rotor into the diffuser into which the cooling-air flow enters with a velocity vector which essentially corresponds to the average velocity vector of the exhaust-gas flow entering into the diffuser. This avoids the flow losses which occur when the cooling-air flow passes out into the exhaust-gas flow in the area of the last stage or stages. At the same time, the temperature difference between the rotor circumference and the last rotor disk (4), likewise cooled by tapped air from the compressor, is in this way reduced, as a result of which the thermal stresses in the rotor are also reduced.

6 Claims, 3 Drawing Sheets

AXIAL FLOW GAS TURBINE

BACKGROUND OF THE INVENTION

Field of the Invention

The present invention relates to an axial flow gas turbine having cooling devices for the turbine rotor and its moving blade rings, the cooling air being tapped from the compressor and accelerated in a known manner by a swirl device in the peripheral direction in such a way that it has zero velocity in the peripheral direction relative to cooling-air bores at the turbine rotor through which the cooling air flows into the cooling-air system.

In gas turbines of high performance density, special importance is attached to the cooling of the components subjected to high temperature—these are the blades, in particular the moving blades, which, apart from high temperatures and gas forces, are also subjected to centrifugal forces—and also of the rotor. This is with regard to the efficiency, which, inter alia, depends on the inlet temperature of the fuel gases. The maximum permissible inlet temperature is limited by the durability to be achieved of the thermally stressed components.

Compared with a gas turbine without cooling of these parts, a gas turbine having cooling of the same permits a higher gas inlet temperature, which increases the efficiency and the performance.

Discussion of Background

In the known industrial gas turbines, the cooling-air ducting and the cooling-air flow and its distribution over the length of the turbine rotor depend on the gas temperatures prevailing in the individual stages of the turbine. For the first stages, subjected to the highest temperatures, it may be necessary to cool the moving blades from the inside by a portion of the cooling air flowing around the rotor body being diverted into cooling channels which pass through the relevant moving blades in their longitudinal extent. The heated cooling air flows out at the blade end into the fuel gas flow. In the stages following the blade cooled last, the gas temperature has already dropped so low that internal cooling of the moving blades can be dispensed with. They are merely cooled in the area of the blade roots by the air which flows at the periphery of the rotor body toward its end, and at this location, before and after the root area of the last moving blade row, flows out into the already largely expanded fuel-gas flow and passes together with the latter into the exhaust-gas diffuser.

The cooling air is removed from the compressor after its last stage and passes irrotationally along the circumferential surface of the shaft or drum section located between compressor and turbine into a row of axial bores which, distributed over the periphery of a flat annular surface of the rotor, are present in front of the first turbine stage. Via these bores, the cooling-air flow passes into the cooling channels of the rotor, at the end of which, reduced by the proportion tapped for cooling the hottest moving blades, it comes out into the fuel-gas flow and passes together with the latter into the diffuser.

Since, as stated, the cooling air to the rotor flows in substantially irrotationally, that is, without a peripheral component, in the direction of rotation of the drum, it is accelerated on its path to the rotor by the friction on the circumferential surface of the drum in the peripheral direction of the latter, even if not very briskly in comparison with the peripheral velocity, so that, at the inlet into the said bores and into the rotor cooling channels, there is still a considerable difference in velocity relative to the latter. It must therefore be accelerated there to the rotor peripheral velocity. The drum and the rotor must therefore perform pump work, which, moreover, increases the cooling-air temperature. This therefore represents, as does for the most part the flow through the cooling channels, a loss factor.

A further loss is associated with the cooling-air flow coming out at the moving blade root of the last stage. It enters into the fuel-gas flow with a radially, tangentially and axially directed velocity component and deflects it radially so that the hub boundary layer at the diffuser inlet is thickened, which is detrimental to the recovery.

In order to avoid the pump losses, it is proposed in DE-A-No. 3,424,139 of the applicant, by means of fixed swirl cascades having substantially radially directed blades to give the rotor cooling air after it flows out of the compressor, a peripheral velocity component which is directed in the direction of rotation of the rotor and is of the magnitude of the peripheral velocity of the rotor cooling channels so that the cooling air does not first have to be accelerated toward the latter. The pump work mentioned and the losses connected therewith consequently do not occur.

Apart from the cooling of the blading and the rotor in the area of the blade fixing grooves, it is also necessary in rotors composed of a row of disks welded to one another at the periphery to separately cool the last rotor disk in order to obtain the desired durability. The cooling air for this is removed from the first tapping point of the compressor, that is, at low pressure and low temperature, and fed via the bearing plate after the last rotor disk into the rotor housing, from where its main portion flows radially outwards and, through a narrow annular gap defined by the peripheral edge of the last rotor disk and the adjoining inner circumference of the exhaust-gas diffuser, enters into the diffuser, namely with a velocity component directed radially outward and, on account of the friction of the cooling air at the rotor disk, also with a peripheral component in the direction of rotation of the rotor. A small portion of the cooling air blocks the labyrinth of the shaft bushing at the bearing plate.

SUMMARY OF THE INVENTION

Accordingly, the present invention resulted from the object, by means of appropriate cooling-air ducting for both the rotor and the blades as well as for the rotor disks, of directing this cooling air in its outward areas at the rotor end into the diffuser in such a way that its velocity vectors substantially correspond to that of the average exhaust-gas flow at said areas with regard to amount and direction. In addition, the capacity for doing work of the rotor cooling air is to be largely utilized. By this ducting, the rotor circumference in the area of the last stage, with the same rotor cooling-air quantity, is also to be cooled to a greater extent than is the case in the known designs. The disk cooling-air quantity can thereby be reduced, which reduces the temperature differences inside the rotor and thus the thermal stresses in order to prolong the durability of the turbine rotor. The axial flow gas turbine according to the invention is defined in that, for the cooling-air ducting in the area of the last stage, channels are provided which, in the area of the guide blade ring of the last stage, run in the rotor circumference and, in the area of the moving blade ring of the last stage, run in its blade roots, a cooling-air blade cascade, at least at the end of the last moving blade ring, being present in a cooling-air blade ring which is fixed to the turbine rotor and whose channels are orientated in such a way that the velocity vectors of the cooling air flowing out into the diffuser essentially correspond to the average velocity vector of the exhaust-gas flow, the limits for the outflow of the cooling air into the diffuser being configured in such a way that separation of the cooling air is avoided and the fuel-gas flow in the hub area of the last moving blade ring is homogenized.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figures 1, 2, 3:
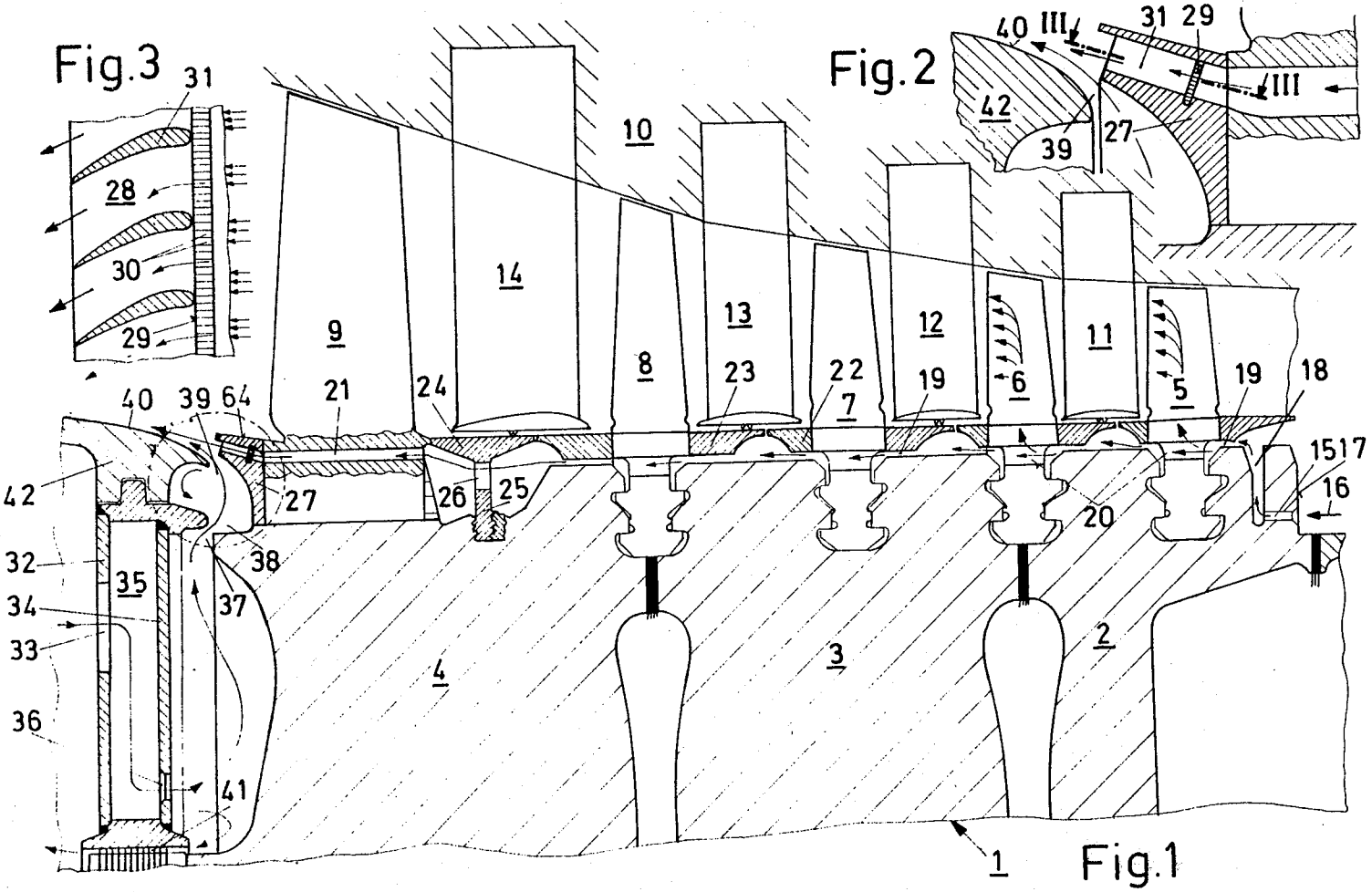
FIG. 1 shows a longitudinal section through a half of a gas turbine rotor with schematic representation of the blading.
FIGS. 2 and 3 show details from FIG. 1.

Referring now to the drawings, wherein like reference numerals designate identical or corresponding parts throughout the several views, FIG. 1 shows a part of a turbine rotor 1 which is composed of forged rotor disks 2, 3, 4 which are welded to one another along rings forged together at their end faces. The blades of the moving blade rings 5 to 9 are inserted in known manner with their root of double hammer-head profile into the correspondingly profiled blade fixing grooves. Between two adjacent moving blade rings, guide blades of guide blade rings 11 to 14 are anchored in a guide blade support 10 in a similar manner to the moving blades in the rotor. Since they are unnecessary in the present connection, the guide blade fixings are only indicated schematically.

For cooling the rotor circumference, which is to be understood as the outermost zone of the rotor with its fixing grooves for the moving blades and heat-accumulation segments, and also the moving blades subjected to the highest stress by the fuel gas, the requisite cooling-air flow is removed from the last stage of the compressor (not shown)—it is located to the right of the first moving blade ring 5 of the turbine—whereupon a swirl blade cascade which is arranged between the compressor and the first turbine stage and is described in DE-A-No. 3,424,139 mentioned at the beginning gives the cooling-air flow a tangential velocity component which is the same as the peripheral velocity of the rotor cooling channels. Thus the cooling air, at the relative velocity zero in the peripheral direction relative to the turbine rotor, enters substantially axially, as indicated by the velocity arrow 16, through a row of cooling-air bores 15 into the cooling channel system of the turbine. Via the cooling-air bores 15, which are provided in large numbers distributed over an annular, flat end face 17 in front of the first moving blade ring, the cooling air passes into an annular groove 18, which widens in a wedge shape in cross-section toward its periphery, and out of the latter through a row of interrupted annular gaps 19 in front of the first moving blade ring 5 and between two each of the following moving blade rings and also finally through channels 20 in the area of the blade roots into blade-root channels 21 of the last moving blade ring 9. The annular gaps 19 are defined by the peripheral surfaces of the rotor circumference and by unsymmetric heat-accumulation segments 22, 23 which are located between two moving blade rings each and protect the rotor circumference and the moving blade roots from overheating by the fuel gas flow. The cylindrical outer surface, exposed to the fuel gas flow, of the longer of the two unsymmetric heat-accumulation segments, together with the two sealing strips on the shroud bands of the guide blades 11 to 14, forms restriction points in order to minimize the losses in the gas flow. For the moving blades of the last stage with their virtually axially directed saw-tooth roots, instead of the heat-accumulation segments 22, 23 arranged in front of and behind the blades, a ring of symmetric heat-accumulation segments 24 is provided which have a separate fixing groove in the rotor circumference for accommodating their blade roots. Their webs 25 can then be provided with any apertures 26 for the cooling air.

The blade-root channels 20, 21 can conveniently be formed from two grooves in the two side flanks each, abutting in the peripheral direction, of adjacent moving blades, which grooves together produce closed channels. However, in the blade roots directed virtually axially, these channels, as in the blades of the last moving blade ring 9, can also be provided in the blade grooves themselves.

In gas turbines of high power density, the guide and moving blades of the stages subjected to the highest temperatures, for example the first two stages, are generally constructed as hollow blades having air cooling. For the moving blades, the cooling air at the blade roots is diverted from the cooling-air flow described. Since they are not essential to the invention, the elements for the blade cooling are not shown in FIG. 1.

From the blade root channels 21 of the last moving blade ring 9, the cooling air passes into a cooling-air blade ring 27 which is fixed to the rotor body and, just inside its periphery, has a truncated-cone-shaped moving blade cascade 28 which, distributed uniformly over its periphery, has cooling-air blades 31 in front of which is connected a rectifying ring 29 which, distributed over the entire cross-section of flow, has honeycombed channels 30.

FIG. 2 shows the encircled detail II from FIG. 1 to a larger scale, and FIG. 3 shows the developed view along the section line III—III, drawn in FIG. 2, in the form of a cone shell placed through the channel center. The rectifying ring 29 has the task of homogenizing the cooling-air streams passing out of the blade-root channels 21 of the last moving blades 9 in order to obtain a flow, as free of separation as possible, into the channels defined by the blades 31.

The cooling-air blade ring 27 fulfills a part of the inventive task set in the introduction by diverting the stream lines of the cooling-air flow in such a way that their velocity vectors, over the entire periphery of the diffuser hub, essentially coincide with the average velocity vector of the exhaust-gas flow, with the loss-reducing effect described at the beginning, by energy being supplied to the low-energy boundary layer at the diffuser hub and its separation point being displaced downstream. At the same time, the energy of the rotor cooling air is partly utilized for transferring work to the rotor.

These actions of the cooling-air flow are assisted by the secondary measure according to the invention, which is that the cooling air used to cool the last rotor disk 4 and tapped from the compressor, like the blade cooling air, also flows out in a directed manner into the diffuser. The disk cooling air passes through two disk air channels 33, provided in an outer turbine housing base 32, into a disk-shaped hollow space 35 defined by the base 32 and an inner turbine housing base 34, is deflected in this hollow space 35 radially inward toward the rotor access, as indicated by the velocity arrows, and passes through a row of inner disk air channels 36, provided near the axis, in front of the rotor disk 4, where its main portion is directed upwards and is blown out via an annular gap 37 and an annular space 38 through the annular slot 39 into the hub boundary layer. Apart from the inner contour of the cooling-air blade ring 27, the convexly curved intake area 40 of the diffuser hub 41 also helps the inflow, intended according to the invention, into the hub boundary layer, which intake area 40, due to its curvature, draws in the outflowing disk cooling air together with the reactor cooling air. The truncated-cone-shaped circumferential surface 64 of the cooling-air blade ring 27 is constructed so as to be inclined relative to the rotor axis and is dimensioned in length in such a way that the exhaust-gas flow is homogenized behind the last moving blade ring 9.

A small portion of the disk cooling air flowing in through the channel 36 blocks the labyrinth 41 at the bearing plate.

Figures 4, 5:
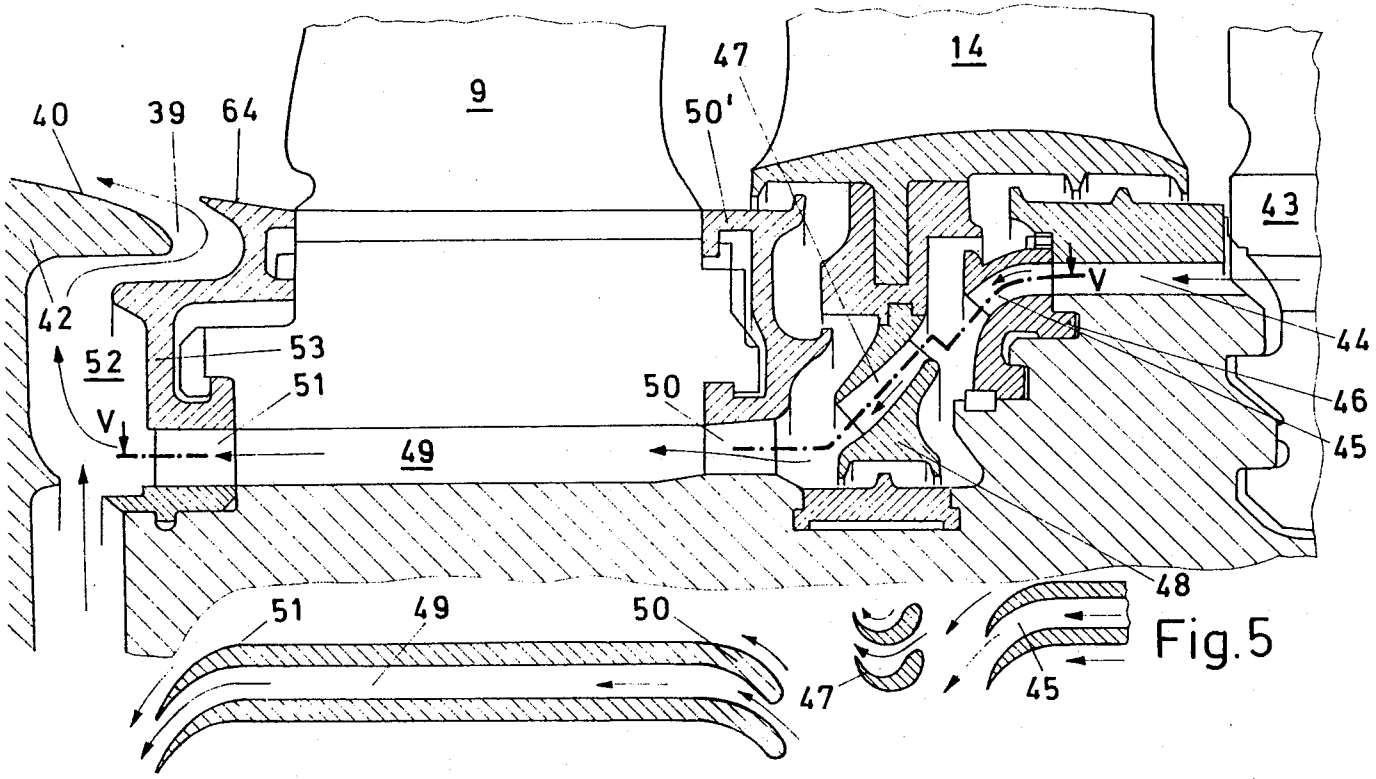
FIG. 4 shows a further exemplary embodiment, FIG. 5 show details from this exemplary embodiment.

FIGS. 4 and 5 show a second embodiment of the rotor cooling-air ducting. After the penultimate moving blade ring 43, the cooling air, via an intermediate channel 44 fixed to the rotor, enters into a blade cascade 45 of a blade-cascade ring 46 fixed to the rotor and passes out of this blade cascade 45 into blade cascade 47 of a blade-cascade ring 48 fixed to a guide blade, from which blade cascade 47 it is deflected into end channels 49. The inlet parts of the same consist of the front half 50 of a blade cascade, the profile projections, in a blade-cascade ring 50' fixed to the rotor, and the outlet area from the rear half 51 of this blade cascade in the cooling-air blade ring 53. In FIG. 5, the end channels 49 are shown running parallel to the rotor axis, but as a rule they will be provided running at an incline relative to the rotor axis, e.g. at an angle of 5 to 7 degrees. The cooling air flowing out at the rotor end then enters, together with the disk cooling air still necessary, via the annular space 52 at the rotor end and via the intake area 40 of the diffuser hub into the exhaust-gas flow.

Figure 6:
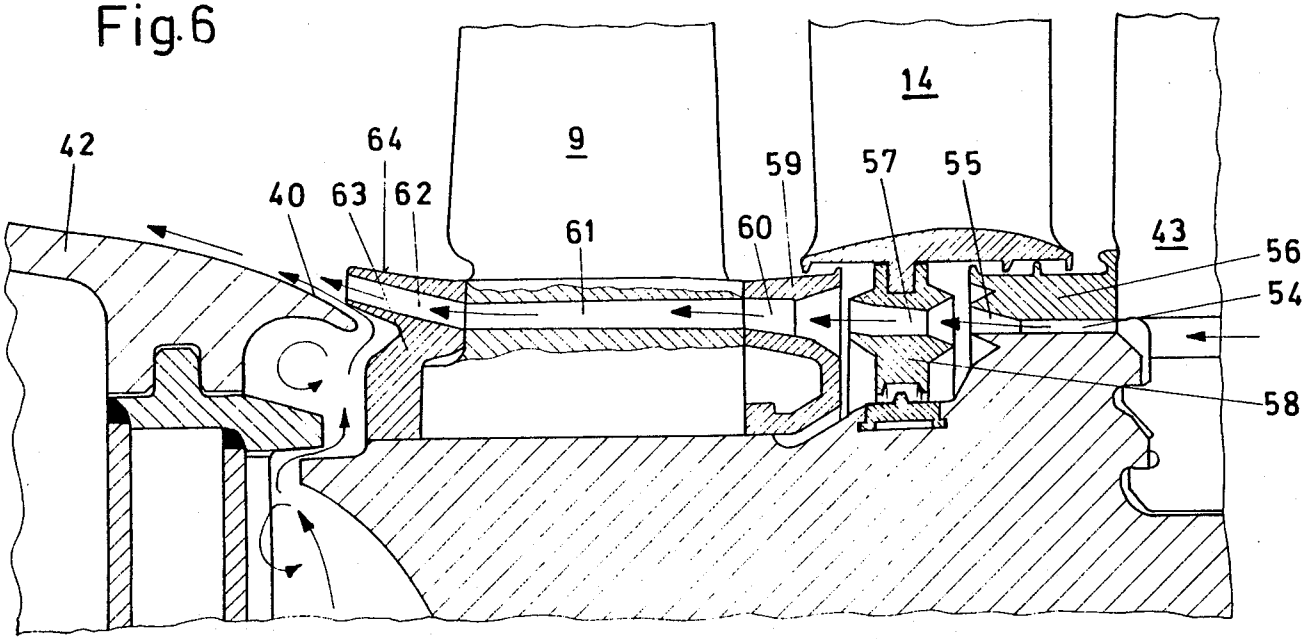
FIG. 6 shows a third variant of the invention.

FIG. 6 shows a further embodiment of the invention. After the penultimate moving blade ring 43, the cooling air is axially directed essentially up to the end of the moving blade ring 9 and only there is it blown out through a cooling-air blade ring 63 in the desired direction into the exhaust-gas flow. After the penultimate moving blade ring 43, as in the embodiment in FIG. 4, it again passes through an intermediate channel 54 and a blade cascade 55 in a blade-cascade ring 56 fixed to the rotor, a blade cascade 57 in a blade-cascade ring 58 fixed to a guide blade, then a blade-cascade ring 59 which is fixed to the rotor and the last moving blade ring 9 and whose blade cascade 60 consists of the front blade halves, while the rear blade halves form the blade cascade 62 in the cooling-air blade ring 63. The end channels 61 extend between the two blade cascades 60 and 61 as in the embodiment in FIG. 4, and in fact preferably inclined at an angle to a line parallel to the axis.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An axial flow gas turbine, having cooling devices for the turbine rotor (1) and its moving blade rings (5 to 9), the cooling air being tapped from the compressor and accelerated in a known manner by a swirl device in the peripheral direction in such a way that it has zero velocity in the peripheral direction relative to cooling-air bores (15) at the turbine rotor (1) through which the cooling air flows into the cooling-air ducting system, wherein, for the cooling-air ducting in the area of the last stage (9 +14), channels (26, 21, 28; 44, 45, 47, 50, 49, 51, 52, 39; 54, 55, 57, 60, 61, 62) are provided which, in the area of the guide blade ring (14) of the last stage, run in the rotor circumference and, in the area of the moving blade ring (9) of the last stage, run in its blade roots, a cooling-air blade cascade (28; 51; 62), at least at the end of the last moving blade ring (9), being present in a cooling-air blade ring (27; 53; 63) which is fixed to the turbine rotor (1) and whose channels are orientated in such a way that the velocity vectors of the cooling air flowing out into the diffuser essentially correspond to the average velocity vector of the exhaust-gas flow, the limits for the outflow of the cooling air into the diffuser being configured in such a way that separation of the cooling air is avoided and the fuel-gas flow in the hub area of the last moving blade ring (9) is homogenized.

2. The gas turbine as claimed in claim 1, wherein the cooling-air channel in the area of the last guide blade ring (14) is formed by an annular groove, covered by symmetric heat-accumulation segments (24), in the rotor body and by apertures (26) in the webs (25) of these heat-accumulation segments (24), wherein blade-root channels (21) are provided for the cooling-air ducting in the area of the last moving blade ring (9), and wherein a rectifying ring (29), as viewed in the flow direction, is placed in front of the cooling-air blade cascade (28) in the cooling-air blade ring (27).

3. The gas turbine as claimed in claim 1, wherein the cooling-air ducting in the area of the last guide blade ring (14) consists of intermediate channels (54) in the rotor circumference, a blade cascade (55), fixed to the rotor, at the end of these intermediate channels and a blade cascade (57) in a blade-cascade ring (58) fixed to a guide blade, and wherein the cooling-air ducting in the area of the last moving blade ring (9) has a blade cascade (60) n a blade-cascade ring (59) fixed to the rotor, which blade cascade (60) consists of the front blade halves forming the blade projections, furthermore end channels (61) in the blade roots of the last moving blade ring (9) and also a cooling-air blade ring (63) fixed to the rotor and having a cooling-air blade cascade (62) which consists of the rear blade halves.

4. The gas turbine as claimed in claim 1, wherein the cooling-air ducting in the area of the last guide blade ring (14) has intermediate channels (44) fixed to the rotor, a blade-cascade ring (46) fixed to the rotor and having a curved blade cascade (45) directed toward the rotor axis, and also a blade cascade (47), directed toward the rotor axis, in a blade-cascade ring (48) fixed to a guide blade, and wherein the cooling-air ducting in the area of the last moving blade ring (9) has a blade cascade (50) in a blade-cascade ring (50') fixed to the rotor, which blade cascade (50) consists of the front blade halves forming the blade projections, furthermore end channels (49) in the area of the blade roots of the last moving blade ring (9), and a cooling-air blade ring (53) fixed to the rotor and having a cooling-air blade cascade (51) which consists of the rear blade halves, and furthermore comprising an annular space (52) and an annular slot (39) between the cooling-air blade ring (53) and the diffuser hub (42).

5. The gas turbine as claimed in claim 2, wherein the intake area (40) of the diffuser hub (42) is profiled in a stream linedshape in axial section.

6. The gas turbine as claimed in claim 1, wherein the truncated-cone-shaped circumferential surface (64) of the cooling-air blade ring (27; 53; 63) is constructed so as to be inclined relative to the rotor axis and dimensioned in such a way that the exhaust-gas flow is homogenized behind the last moving blade ring (9).

* * * * *